US005113726A

United States Patent [19]

Ethridge

[11] Patent Number: 5,113,726

[45] Date of Patent: May 19, 1992

[54] UTILITY TOOL

[76] Inventor: Richard T. Ethridge, 807 Engineer St., Corbin, Ky. 40701

[21] Appl. No.: 592,597

[22] Filed: Oct. 4, 1990

[51] Int. Cl.[5] ..... B25B 13/46

[52] U.S. Cl. ..... 81/60; 81/58

[58] Field of Search ..... 81/58, 58.2, 58.5, 60, 81/61

[56] References Cited

U.S. PATENT DOCUMENTS

| | | | |
|---|---|---|---|
| 878,388 | 2/1908 | Heimann | 81/58.5 |
| 2,474,402 | 6/1949 | Napier | 81/61 X |
| 2,758,493 | 8/1956 | Goldwater | 81/58.2 |
| 2,859,649 | 11/1958 | Nelson | 81/61 |
| 3,504,579 | 4/1970 | Harlan | 81/58.2 |
| 4,258,595 | 3/1981 | Ramsey | 81/61 |

FOREIGN PATENT DOCUMENTS

| | | | |
|---|---|---|---|
| 18561 | 6/1910 | United Kingdom | 81/58.2 |

*Primary Examiner*—James G. Smith

*Attorney, Agent, or Firm*—Pitts & Brittian

[57] ABSTRACT

A utility tool (10) for gripping a pipe nut and rotating the pipe nut about a pipe. The utility tool (10) includes a pair of cooperating jaw members (20 and 34) pivotally connected at one end (26 and 42) such that the jaw members (20 and 34) may be opened to receive a pipe nut (130) and closed to grip the pipe nut (130). A fixing device (54) is connected to the jaw members (20 and 24) such that the jaw members (20 and 24) may be selectively fixed in the closed position. A lever (14) is included to apply torque to the pipe nut (130) thereby causing the pipe nut (130) to revolve about a pipe (132). A ratchet (18) is included to connect the lever (14) to the jaw members (20 and 34) such that the lever (14) may be selectively engaged and removed and such that the lever (14) may move freely about the jaw members (20 and 34) in a selected direction (136) and in the opposite direction (134) the lever (14) may engage the jaw members (20 and 34) in order to rotate the pipe nut (130).

6 Claims, 3 Drawing Sheets

UTILITY TOOL

DESCRIPTION

1. Technical Field

This invention relates to the field of wrenches. More specifically it relates to a tool used to firmly grip a nut on a typical pipe and allow the nut to be rotated about the pipe in a ratcheting fashion without necessitating the removal of the wrench.

2. Background Art

It is known that when working with piping it is necessary to employ a special wrench to tighten and loosen nuts engaged along the length of the pipe. Often pipes are located such that little space is afforded for the engagement of a wrench thereby requiring the wrench to be removed after each partial rotation and replaced in the original position, this procedure continuing until the nut is tightened or loosed the desired amount.

Several devices have been produced to secure pipes or pipe nuts such that the pipe need not be disconnected in order to loosen or tighten the pipe nuts. Typical of the art are those devices disclosed in U.S. Pat. Nos. 67,937 issued to W. C. Abbe on Aug. 20, 1867; 73,637 issued to H. C. Barlow on Dec. 22, 1896; 615,926 issued to W. Tyack on Dec. 13, 1898; 678,809 issued to J. E. Wilkison on Jul. 16, 1901; 791,814 issued to W. M. Pitzer on Jun. 6, 1905; 837,809 issued to J. J. Dixon on Dec. 4, 1906; 2,708,384 issued to M. Mann on May 17, 1955; and 2,814,225 issued to M. Mann on Nov. 26, 1957. The 791,814 patent is the only of these patents that is designed to be moved alternately in opposite directions in order to affect a complete revolution of the pipe without removing the wrench. This patent, however, is only designed to facilitate a pipe and would not give the proper contact of the nut and would damage the edges due to the method of gripping. Only the U.S. Pat. Nos. 2,708,384 and 2,814,225 patents are designed to grip a pipe nut, but neither of these allow for affecting a complete revolution of the nut with respect to the pipe without requiring the removal of the wrench from the nut.

Therefore, it is an object of this invention to provide a means for gripping a pipe nut in such a way that the nut may be revolved about a pipe without removing the wrench from the nut.

Another object of this invention is to provide a means for locking the wrench onto a pipe nut.

Still another object of this invention is to provide a means whereby the wrench may be affixed to a variety of diameters of pipe nuts.

DISCLOSURE OF THE INVENTION

Other objects and advantages will be accomplished by the present invention which provides a means for gripping a pipe nut located along the length of a pipe in such a manner as to enable the pipe nut to be rotated about the pipe. The utility tool also provides a means for rotating the pipe nut about the pipe in a selected direction at least one complete revolution without requiring the removal of the gripping device. Further, the utility tool provides a means whereby the pipe nut may be rotated at least one complete revolution about a pipe in a confined space. The utility tool also provides a means whereby the lever portion of the device may be selectively engaged and removed, thereby allowing the lever portion to be used in cooperation with gripping devices having a variety of shapes and sizes.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

Figure 1:
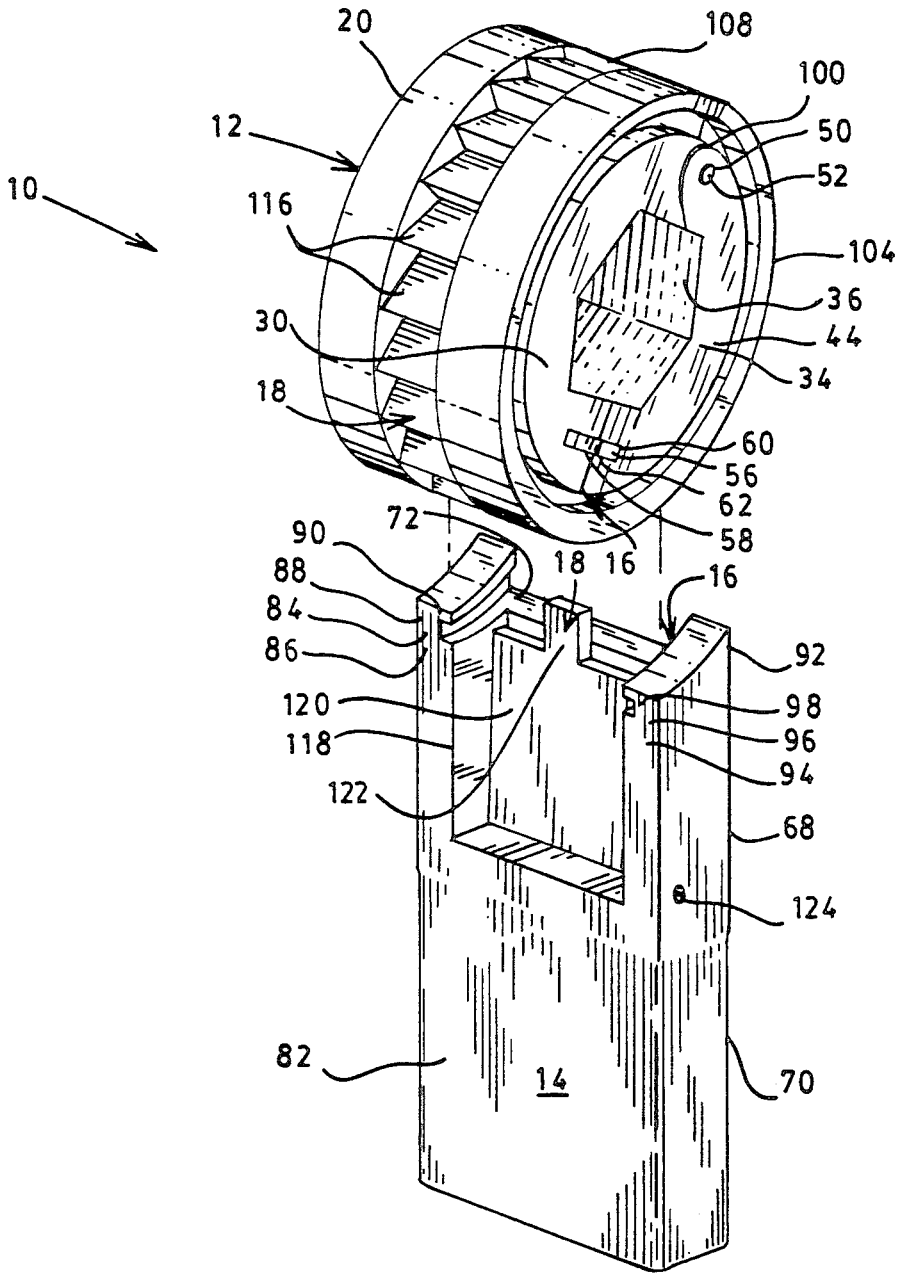
FIG. 1 is a perspective view of the utility tool constructed in accordance with several features of the present invention showing the lever arm disengaged from the jaw assembly.
Figure 2:
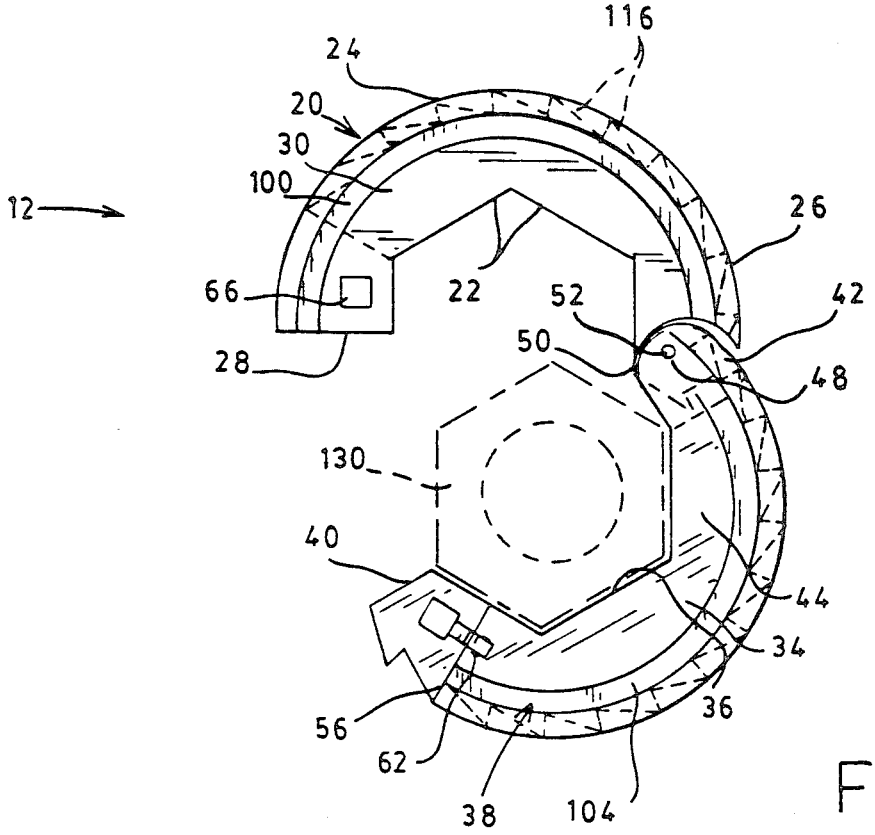
FIG. 2 illustrates a front elevation view of the jaw assembly of the utility tool shown in FIG. 1.
Figure 3:
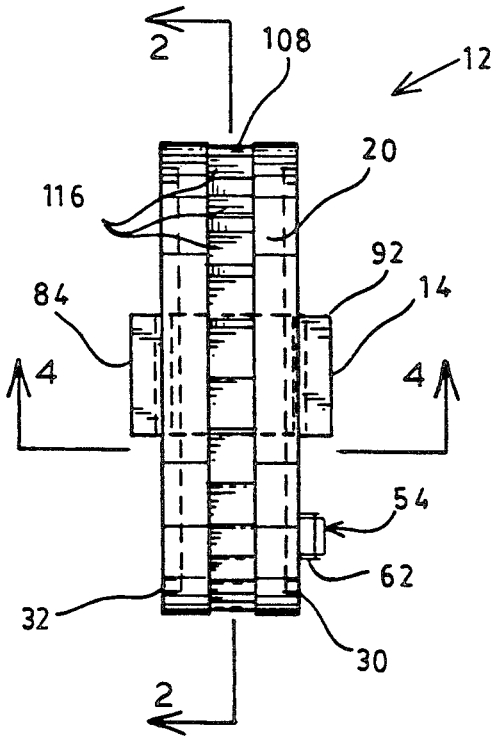
FIG. 3 illustrates a top view of the utility tool shown in FIG. 1.
Figure 4:
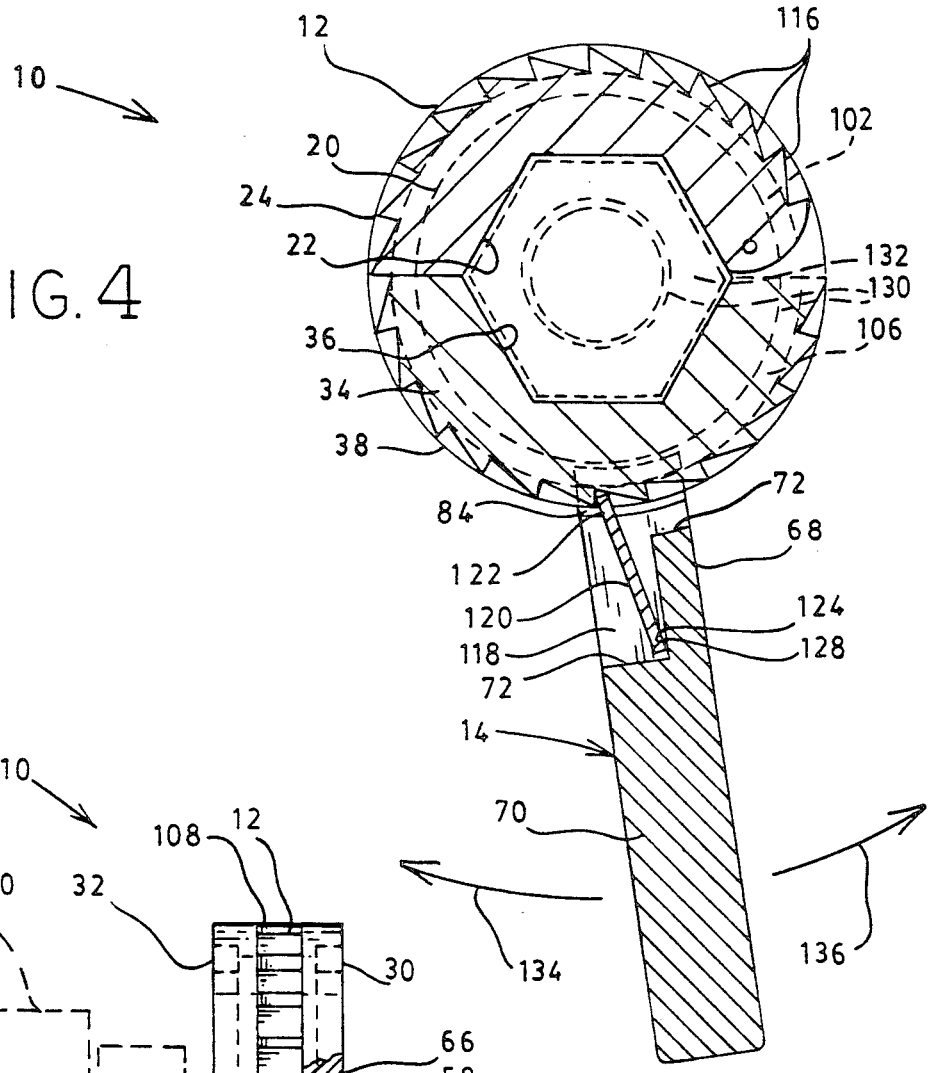
FIG. 4 illustrates a front elevation view, in section, of the utility tool taken at 2—2 of FIG. 3.
Figure 5:
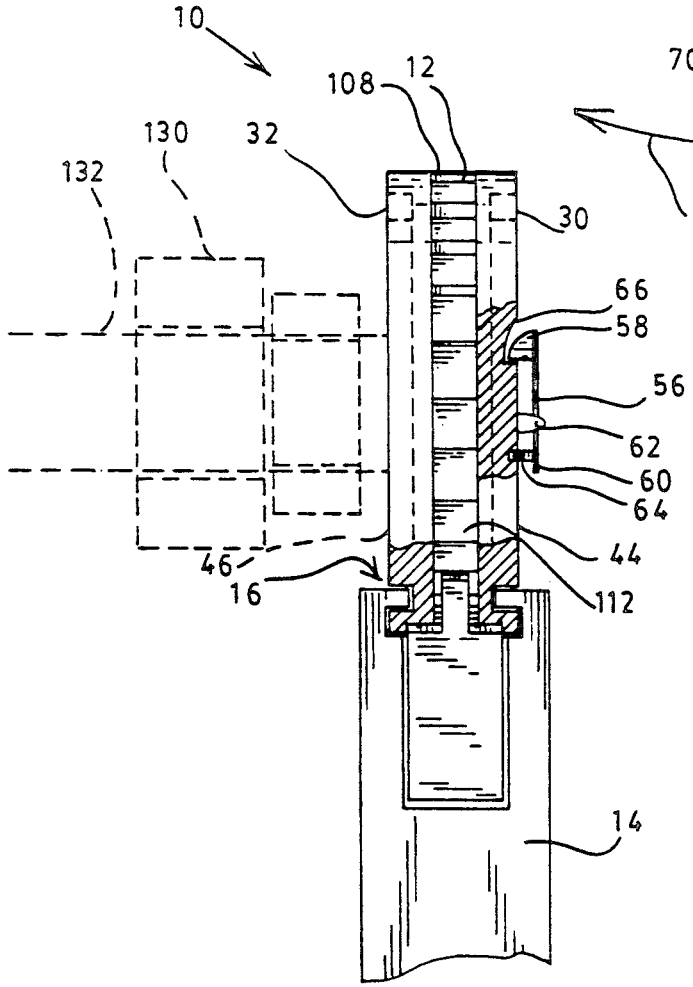
FIG. 5 illustrates a side elevation view, partially in section, of the utility tool taken at 4—4 of FIG. 3.

A utility tool incorporating various features of the present invention is illustrated generally at 10 in the figures. The utility tool 10 is designed for gripping a pipe nut 130 and rotating the pipe nut 130 about a pipe 132 to selectively tighten or loosen the pipe nut 130.

The utility tool 10 includes a nut engaging means 12 dimensioned to grip a pipe nut 130 of a selected shape and diameter. The nut engaging means 12 includes a first jaw member 20 and a second jaw member 34, the jaw members 20 and 34 respectively having inner faces 22 and 36 dimensioned to grip the circumference of a pipe nut 130 when the jaws 20 and 34 are closed in a cooperating fashion, and outer faces 24 and 38 with a semicircular configuration such that the jaw members 20 and 34 have an exterior circular configuration when closed. The jaw members 20 and 34 respectively include first ends 26 and 40 which are bifurcated and second ends 28 and 42, each defining a tongue. The first end 40 of the second jaw member 34 is dimensioned to receive the second end 28 of the first jaw member 20 and the first end 26 of the first jaw member 20 is dimensioned to receive the second end 42 of the second jaw member 34. The first end 26 of the first jaw member 20 and the second end 42 of the second jaw member 34 further respectively include through holes 48 and 50 opening on the first faces 30 and 44 and second faces 32 and 46 of the jaw members 20 and 34, the holes 48 and 50 being dimensioned to cooperate to receive a pivot pin 52.

A fixing means 54 is connected to the first and second jaw members 20 and 34 allowing the nut engaging means 12 to be selectively opened to insert or remove a pipe nut 130 and closed to grip a pipe nut 130. In the preferred embodiment, the first face 30 of the first jaw member 20 includes a recess 66 proximate the second end 38. The first face 44 of the second jaw member 34 carries a rocker arm 56 connected with a connecting pin 62 to the second jaw member 34 proximate the first end 40. The rocker arm 56 includes a first end 58 dimensioned to be received by the recess 66 on the first face 30 of the first jaw member 20 when the jaw members 20 and 34 are in the closed position and a second end 60 which is connected with a spring 64 to the first face 44 of the second jaw member 34 in such a way as to bias the first end 58 of the rocker arm 56 toward the first faces 30 and 44 of the jaw members 20 and 34.

The utility tool 10 includes a lever 14 for applying torque to the nut engaging means 12 to tighten or loosen a pipe nut 130 and is connected to the nut engaging means 12 with a lever engaging means 16. In the preferred embodiment the lever 14 includes a lower end 70 carrying a handle portion 82 dimensioned to be received by a user's hand and an upper end 68 with a top face 72 carrying a portion of the lever engaging means 16.

The lever engaging means 16 of the preferred embodiment includes first and second extended portions 84 and 92 from the upper end 68 of the lever 14 and grooves 100, 104, 102 and 106 on the first faces 30 and 44 and second faces 32 and 46 of the jaw members 20 and 34 respectively. The extended portions 84 and 92 include first legs 86 and 94, elbows 88 and 96 and second legs 90 and 98. The first legs 86 and 92 are parallel to each other and extend axially from the lever 14 to the elbows 88 and 96. The second legs 90 and 98 extend from the elbows 88 and 96 in opposing directions toward each other. The grooves 100, 104, 102 and 106 are concentric with the nut engaging means 12 and dimensioned to receive the second legs 90 and 98 of the extended portions 84 and 92 respectively such that the lever 14 may move freely about the nut engaging means 12 in both directions 134 and 136 and such that the lever 14 may be selectively removed from and connected to the nut engaging means 12.

The utility tool 10 includes a ratcheting means 18 to transfer the forces from the lever 14 to the nut engaging means 12 when applied in a rotational direction depicted by arrow 134 thereby causing the nut engaging means 12 and a nut to rotate about a pipe 132, and to allow the lever 14 to move freely about the nut engaging means 12 when forces are applied in the rotational direction depicted by arrow 136. In the preferred embodiment, the ratcheting means 18 includes a series of teeth 116 about the central portions 108 and 112 of the outer faces 24 and 38 of the jaw members 20 and 34, a recess 118 opening on at least the top face 72 of the lever 14, a pawl 120 dimensioned to be received by the recess 118, and a pivot pin 124 to connect the pawl 120 to the lever 14 and bias the pawl 120 in a substantially axial direction toward the nut engaging means 12. The pawl 120 includes an extended portion 122 dimensioned to interact with the teeth 116 such that when the lever 14 is moved in the rotational direction depicted by arrow 134 the nut engaging means 12 is engaged and acts to rotate a pipe nut 130, and when the lever 14 is moved in the rotational direction depicted by arrow 136 the pivoting pin 124 allows the pawl 120 to slip over the teeth 116 without rotating the pipe nut 130.

From the foregoing description, it will be recognized by those skilled in the art that a utility tool offering advantages over the prior art has been provided. Specifically, the utility tool provides a means for gripping a pipe nut located along the length of a pipe in such a manner as to enable the pipe nut to be rotated about the pipe. The utility tool also provides a means for rotating the pipe nut about the pipe in a selected direction at least one complete revolution without requiring the removal of the gripping device. Further, the utility tool provides a means whereby the pipe nut may be rotated about a pipe in a confined space where the angle that a wrench may be rotated is small.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A utility tool for rotating a pipe nut about a pipe, said pipe nut having a selected diameter and a selected peripheral shape, said utility tool comprising:

a nut engaging means for gripping said pipe nut, said nut engaging means having first and second jaw members with a first end of said first jaw member pivotally joined to a first end of said second jaw member, said first and second jaw members each having opposite side faces and each having internal surfaces for closely engaging said selected peripheral shape of said pipe nut, said nut engaging means further having releasable locking means for releasably joining second ends of each of said first and second jaw members whereby said first and second jaw members releasably encircle said pipe nut with said internal surfaces engaging said peripheral shape of said pipe nut;

a lever means for rotating said nut engaging means to effect said rotating of said pipe nut;

a lever engaging means for releasably engaging said lever means with said opposite side faces of said first and second jaw members whereby said lever means is releasably engaged with said nut engaging means, said lever engaging means comprising cooperating semicircular grooves in said opposite side faces of said first and second jaw members, said semicircular grooves forming oppositely disposed circular grooves when said first and second jaw members are engaged with said pipe nut and leg members carried by said first end of said lever means, said leg members releasably engageable with said semicircular grooves of one of said jaw members when said first and second jar members are disengaged from said pipe nut whereby said leg members are movable along said circular grooves when said first and second jaw members are engaged with said pipe during ratcheting movement of said lever means; and ratchet means cooperatively associated with said lever means and with said nut engaging means whereby ratcheting movement of said lever means in one direction effects rotation of said nut engaging means and ratcheting movement of said lever means in an opposite direction does not effect rotation of said nut engaging means whereby said pipe nut is rotated in a selected direction by said utility tool.

2. The utility tool of claim 1 wherein said ratchet means comprises:

a semi-cylindrical toothed surface on a central portion of exterior surfaces of each of said first and second jaw members, said semi-cylindrical toothed surfaces forming a cylindrical toothed surface when said first and second jaw members are joined around said pipe nut; and a pivotable pawl member mounted in said first end of said lever means, said pawl member having an extended end portion to engage said cylindrical toothed surface when said lever means is engaged with said nut engaging means and said first and second jaw members are joined around said pipe nut whereby said extended end portion acting against said cylindrical toothed surface causes said nut engaging means to rotate said pipe nut when said lever means is moved in a first direction but not rotate said nut engaging means when said lever means is moved in an opposite direction.

3. The utility tool of claim 2 wherein said first end of said lever means is provided with axially-extending arms to form a U-shaped yoke defining an opening between said arms to receive one of said first and second jaw members, wherein said pawl means is pivotally mounted at a base of said yoke, and wherein said legs for engaging said grooves in said side faces of said first and second jaw members are directed inwardly from said arms toward a center of said yoke.

4. The utility tool of claim 1 wherein said releasable locking means for said second ends of said first and second jaw members comprises:

a tongue member at said second end of both said first and second jaw members, said two tongue members configured for overlapping relationship when said first and second jaw members are closed toward each other, one of said tongue members provided with a recess facing the other of said tongue members; and a rocker member pivotally mounted in said other of said tongue members, said rocker member having an a first end for engagement with said recess when said first and second jaw members are closed, and a second end for manipulation to release said first end from said recess when said first and second jaw members are to be separated.

5. A utility tool for rotating a pipe nut about a pipe, said pipe nut having a selected diameter and a selected peripheral shape, said utility tool comprising:

a nut engaging means for gripping said pipe nut, said nut engaging means having first and second jaw members with a first end of said first jaw member pivotally joined to a first end of said second jaw member, said first and second jaw members having substantially semi-cylindrical peripheral surfaces and internal surfaces for closely engaging said selected peripheral shape of said pipe unit, each of said first and second jaw members being provided with semicircular grooves in opposite side faces thereof, said semicircular grooves forming oppositely disposed circular grooves when said first and second jaw members are engaged with said pipe nut, each of said first and second jaw members further provided with a semi-cylindrical toothed surface on a central portion of said peripheral surface whereby said semi-cylindrical toothed surfaces form a cylindrical toothed surface when said first and second jaw members are closed, said nut engaging means further having releasable locking means for releasably joining second ends of each of said first and second jaw members whereby said first and second jaw members releasably encircle said pipe nut with said internal surfaces engaging said peripheral shape of said pipe nut;

a lever means for rotating said nut engaging means to effect said rotating of said pipe nut, said lever means provided at a first end with a pair of axially-extending arms to form a U-shaped yoke defining an opening between said arms to receive one of said first and second jaw members, each of said arms forming an inwardly directed leg to engage said semicircular grooves in said side faces of one of said first and second jaw members whereby said lever means is releasably engaged with said nut engaging means when said legs are engaged with said grooves; and pawl means mounted in a base of said yoke, said pawl means having a pivotal pawl with an extended end portion to engage said cylindrical toothed surface when said lever means is engaged with said nut engaging means and said first and second jaw members are joined around said pipe nut whereby said extended end portion of said pawl acting against said cylindrical toothed surface causes said nut engaging means to rotate said pipe nut when said lever means is moved in a first direction but not rotate said nut engaging means when said lever means is moved in an opposite direction.

6. The utility tool of claim 5 wherein said releasable locking means for said second ends of said first and second jaw members comprises:

a tongue member at said second end of both said first and second jaw members, said two tongue members configured for overlapping relationship when said first and second jaw members are closed toward each other, one of said tongue members provided with a recess facing the other of said tongue members; and a rocker member pivotally mounted in said other of said tongue members, said rocker member having an a first end for engagement with said recess when said first and second jaw members are closed, and a second end for manipulation to release said first end from said recess when said first and second jaw members are to be separated.

* * * * *